US008882011B2

(12) United States Patent
Romanovich et al.

(10) Patent No.: US 8,882,011 B2
(45) Date of Patent: Nov. 11, 2014

(54) CUTTING SHAFT OIL MANIFOLD

(75) Inventors: Dmitry Romanovich, Wheaton, IL (US); Vadim Romanovich, Glen Ellyn, IL (US)

(73) Assignee: Fellowes, Inc., Itasca, IL (US)

( * ) Notice: Subject to any disclaimer, the term of this patent is extended or adjusted under 35 U.S.C. 154(b) by 598 days.

(21) Appl. No.: 13/170,797

(22) Filed: Jun. 28, 2011

(65) Prior Publication Data

US 2013/0001342 A1 Jan. 3, 2013

(51) Int. Cl.

| | |
|---|---|
| ***B02C 19/00*** | (2006.01) |
| ***B02C 18/00*** | (2006.01) |
| ***B02C 23/18*** | (2006.01) |
| *B02C 18/16* | (2006.01) |

(52) U.S. Cl.

CPC ..... *B02C 18/0007* (2013.01); *B02C 23/18* (2013.01); *B02C 2018/166* (2013.01)

USPC ..... 241/101.2; 241/100; 241/236

(58) Field of Classification Search

USPC ..... 241/100, 101.2, 236, 15, 25, 33, 66

See application file for complete search history.

(56) References Cited

U.S. PATENT DOCUMENTS

| | | | | |
|---|---|---|---|---|
| 1,405,151 | A * | 1/1922 | Overstrom | 241/275 |
| 2,530,249 | A * | 11/1950 | Lee | 184/6 |
| 3,315,438 | A * | 4/1967 | Kostur | 53/141 |
| 4,534,229 | A * | 8/1985 | Funk et al. | 73/863 |
| 5,186,398 | A | 2/1993 | Vigneaux, Jr. et al. | |
| 5,494,229 | A * | 2/1996 | Rokos et al. | 241/15 |
| 5,799,887 | A | 9/1998 | Kroger | |
| 5,961,058 | A | 10/1999 | Kroger | |
| 6,003,796 | A * | 12/1999 | James | 241/27 |
| 6,212,355 | B1 * | 4/2001 | Bunn et al. | 399/325 |
| 7,677,483 | B2 | 3/2010 | Romanovich et al. | |
| 7,798,435 | B2 | 9/2010 | Matlin | |
| 7,946,514 | B2 * | 5/2011 | Matlin et al. | 241/30 |
| 8,376,619 | B2 * | 2/2013 | Akita et al. | 384/279 |

(Continued)

FOREIGN PATENT DOCUMENTS

DE 202009016673 U1 10/2010

OTHER PUBLICATIONS

International Search Report and Written Opinion regarding PCT/US2012/044359, mailed Oct. 29, 2012, 64 pages.

(Continued)

*Primary Examiner* — Shelley Self
*Assistant Examiner* — Homer Boyer
(74) *Attorney, Agent, or Firm* — Pillsbury Winthrop Shaw Pittman LLP

(57) ABSTRACT

A shredder for shredding substrates has a shredder mechanism, a motor, and a pair of cooperating shredding structures each having a set of spaced apart cutter elements interleaving with one another such that substrates are fed between the interleaved sets of cutter elements. At least one of the cooperating shredding structures includes a rotatably mounted shaft rotatable by the motor with its cutter elements mounted in spaced apart relation with spaces therebetween. The shaft has a tubular body with an inner surface defining a hollow interior, an outer surface, and a plurality of openings formed through the tubular body open to the inner and outer surfaces. The openings are open to the spaces between the cutter elements on the shafts. A supply of lubricant communicates with the plurality of openings of the shaft to deliver the lubricant from the interior of the shaft to the cutter elements through the openings.

30 Claims, 11 Drawing Sheets

(56) References Cited

U.S. PATENT DOCUMENTS

| | | | | |
|---|---|---|---|---|
| 8,498,559 | B2 * | 7/2013 | Zess et al. | 399/325 |
| 8,575,247 | B2 * | 11/2013 | Shakir et al. | 524/128 |
| 8,585,358 | B2 * | 11/2013 | Matsuo et al. | 415/176 |
| 2006/0219827 | A1 | 10/2006 | Matlin et al. | |
| 2007/0109753 | A1 | 5/2007 | Bae et al. | |
| 2007/0221767 | A1 * | 9/2007 | Matlin | 241/100 |
| 2007/0246580 | A1 | 10/2007 | Matlin et al. | |
| 2007/0246581 | A1 | 10/2007 | Matlin et al. | |
| 2007/0246585 | A1 | 10/2007 | Matlin et al. | |
| 2007/0246586 | A1 | 10/2007 | Matlin et al. | |
| 2008/0245908 | A1 | 10/2008 | Romanovich et al. | |
| 2010/0021330 | A1 | 1/2010 | Haller | |
| 2010/0051731 | A1 | 3/2010 | Matlin et al. | |
| 2010/0084496 | A1 | 4/2010 | Matlin et al. | |
| 2011/0297769 | A1 | 12/2011 | Matlin et al. | |

OTHER PUBLICATIONS

International Preliminary Report on Patentability issued on Jan. 7, 2014 in PCT/US2012/044359.

* cited by examiner

CUTTING SHAFT OIL MANIFOLD

BACKGROUND OF THE INVENTION

1. Field of Invention

The present invention is generally related to an apparatus having cutter elements disposed on a shaft for destroying a plurality of articles such as paper and discs. In particular, the apparatus comprises an oiling mechanism associated with the shaft for lubricating the cutter elements located thereon.

2. Background

Shredders are well known devices for destroying substrate articles, such as documents, CDs, floppy disks, etc. Typically, users purchase shredders to destroy sensitive articles, such as credit card statements with account information, documents containing company trade secrets, etc.

Typically, a shredder has a shredder mechanism contained within a housing, and the housing has a feed opening enabling substrates to be fed into the shredder mechanism. As with other mechanical devices, wear may be reduced and performance may be maintained by proper lubrication of moving parts. In particular, wear on cutting blades of the shredder mechanism and load on the shredder motor can be reduced by oiling the cutting blades.

In one approach, shredders have relied on lubrication systems having a plurality of nozzles that communicate with a reservoir of oil for spraying the oil directly onto the cutting blades. The plurality of spray nozzles can also optionally spray the oil onto an intermediate surface that enables the oil to flow onto the cutting blades. Examples of such approach are described in U.S. Pat. No. 7,798,435.

In other approaches, the lubrication system for lubricating shredders may include a manifold or openings that enable oil to drip onto the cutting blades. However, these approaches do not direct the oil to the cutting blades at a predictable rate or pattern. Accordingly, these approaches result in inefficiency and waste because some of the oil that drips from the manifold do not eventually drop onto areas of the cutting blades that require lubrication. Examples of such approaches are described in U.S. Pat. Nos. 5,494,229 and 5,186,398.

SUMMARY OF THE INVENTION

One aspect of the invention provides a shredder for shredding substrates, having a housing and a substrate receiving opening provided on the housing. The shredder also includes a shredder mechanism received in the housing and comprising a motor, a pair of cooperating shredding structures each having a set of spaced apart cutter elements interleaving with one another such that substrates fed through the substrate receiving opening are fed between the interleaved sets of cutter elements. At least one of the cooperating shredding structures includes a rotatably mounted shaft rotatable by the motor with its cutter elements mounted in spaced apart relation with spaces therebetween. The shredder mechanism enables substrates to be shredded to be fed between the interleaved sets of cutter elements and the motor is operable to rotate the shaft in a shredding direction so that the cutter elements shred the substrates fed therein. The shaft has a tubular body with an inner surface defining a hollow interior, an outer surface, and a plurality of openings formed through the tubular body open to the inner and outer surfaces, the openings that are open to the spaces between the cutter elements on the shafts. The shredder further includes a supply of lubricant communicating with the plurality of openings of the shaft so as to deliver the lubricant from the interior of the shaft to the cutter elements through the openings.

A preferred aspect of the invention provides each of the cooperating shredding structures with a rotatably mounted shaft each rotatable by the motor with its cutter elements mounted in spaced apart relations with spaces therebetween. The motor is operable to rotate each shaft in a shredding direction so that the cutter elements shred the substrates therebetween. Each shaft has a tubular body with an inner surface defining a hollow interior, an outer surface, and a plurality of openings formed through the tubular body open to the inner and outer surfaces. The openings are open to the spaces between the cutter elements on each shaft. The supply of lubricant communicates with the plurality of openings of the shaft so as to deliver the lubricant from the interior of each shaft to the cutter elements through the openings.

Other objects, features, and advantages of the present invention will become apparent from the following detailed description, the accompanying drawings, and the appended claims.

DETAILED DESCRIPTION OF THE PREFERRED EMBODIMENT(S) OF THE INVENTION

Figure 1:
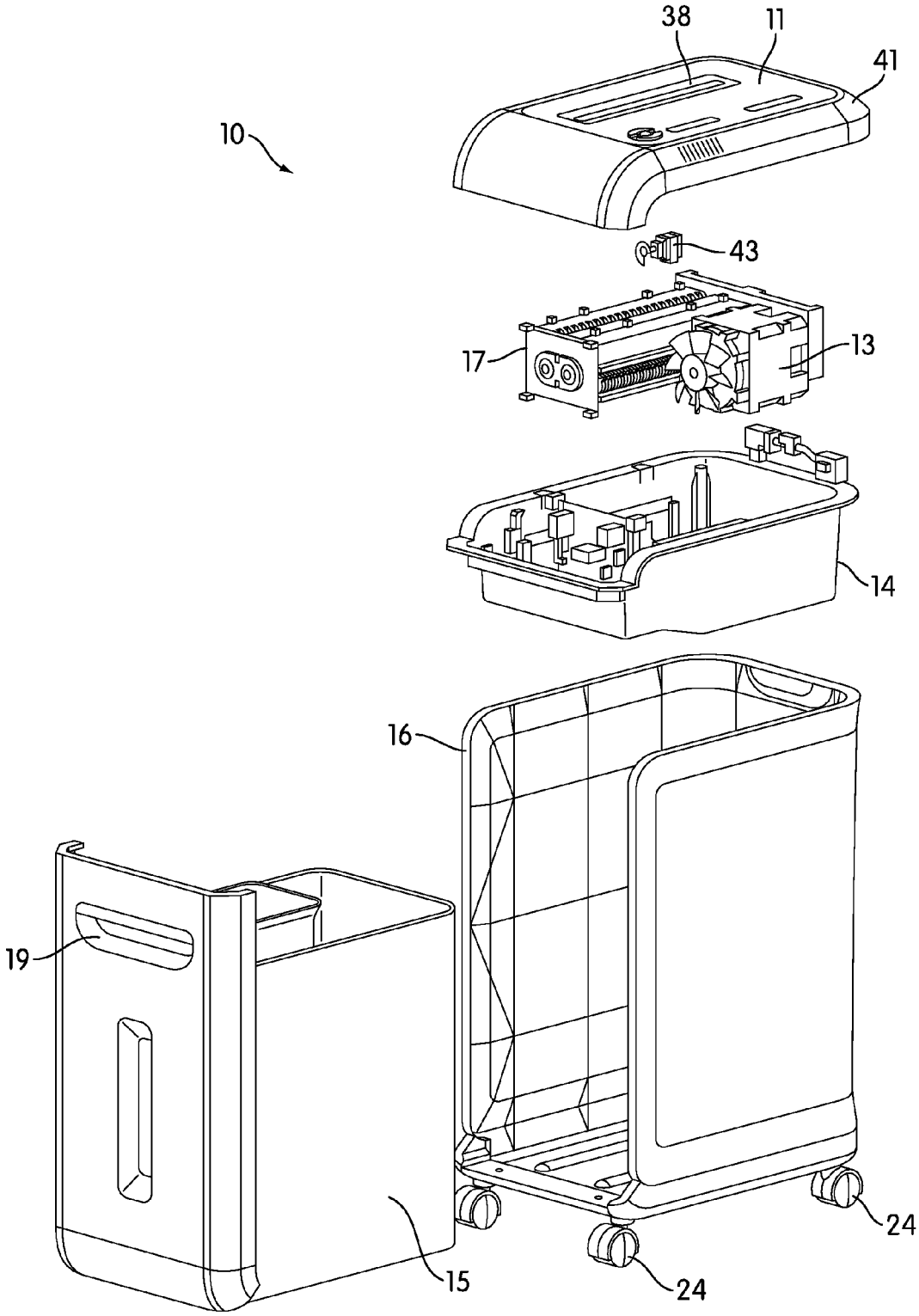
FIG. 1 is a perspective view of a shredder in accordance with an embodiment.

FIG. 1 illustrate a shredder 10 in accordance with an embodiment. As shown in FIG. 1, the shredder includes a housing 41 having a throat 38 for receiving at least one article to be shredded and a shredder mechanism 17 received in the housing 41. The shredder 10 may include a drive system 28 (see FIG. 2) with at least one motor, such as electrically powered motor 13, and a plurality of interleaving cutter elements 25 and 27 (see FIG. 2). A controller (not shown) may be coupled to the electrically powered motor 13 and an optional detector 43 (see FIG. 1) configured to detect a presence or thickness of the at least one article in the throat 38. The motor 13 operates using electrical power to rotatably drive first and second parallel rotatable shafts 20 and 22 (see FIG. 2) and their corresponding cutter elements 25 and 27 so that the cutter elements shred or destroy articles fed therein. The cutter elements 25, 27 may take the form of discs provided on the shafts 20, 22. The first and second rotatable shafts 20, 22 may create an article receiving path 60 to accept article that is inserted into the throat 38.

Figure 2:
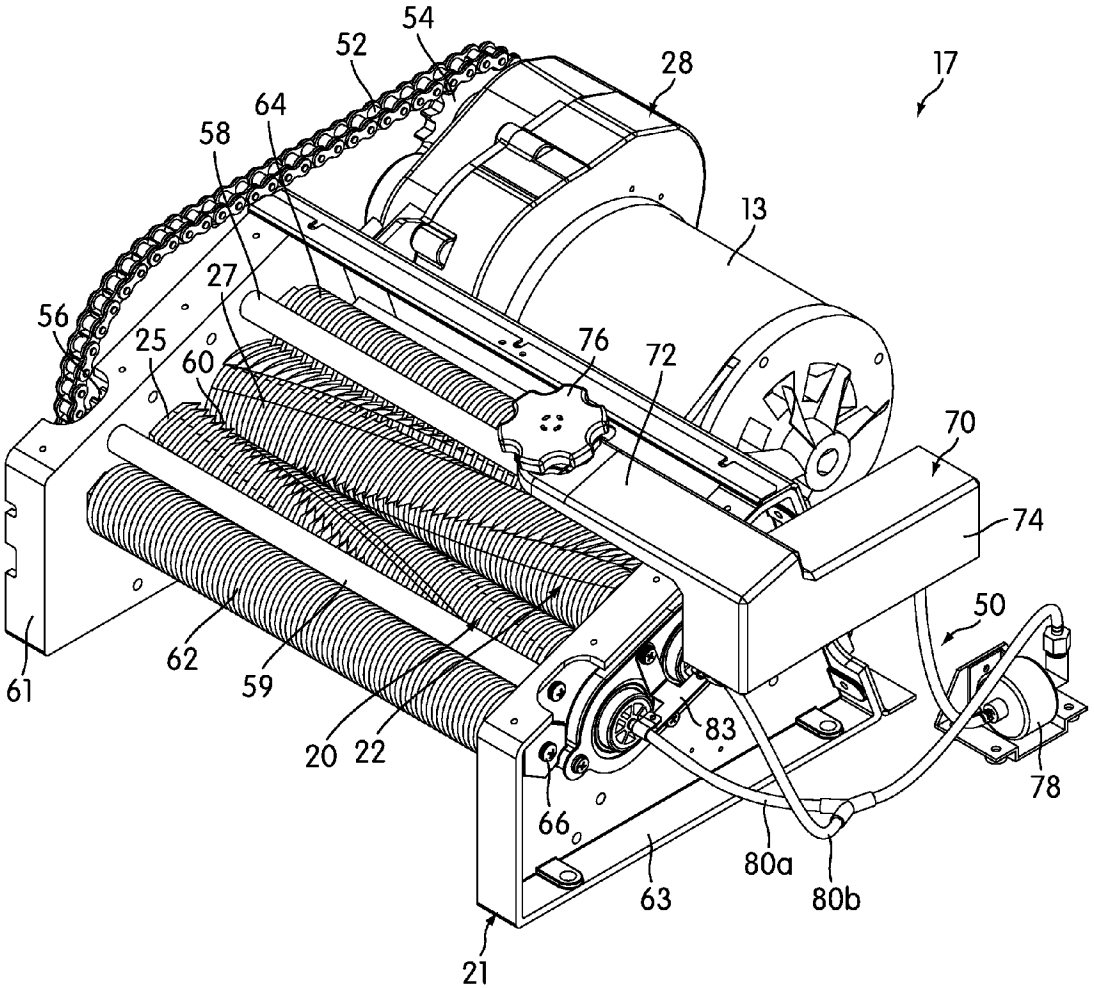
FIG. 2 is a perspective view of a shredder mechanism with a lubrication system in accordance with an embodiment.

In some embodiments, a separate receiving path and throat may be provided to shred compact discs (CDs) or other materials. In the illustrated embodiment only one motor is shown; however, the drive system may have any number of motors. A plurality of the cutter elements 25, 27 are mounted on first and second rotatable shafts 20 and 22 in any suitable manner, and an exemplary embodiment of the shafts 20 and 22 with the cutter elements 25, 27 is illustrated in FIG. 2. Shredder mechanism 17 also may include sub-frame 21 for mounting the shafts 20, 22 and motor 13, for example. The sub-frame 21 may include slanted opposing first and second sides 61, 63 configured to support the sub-frame and components attached to the sub-frame 21. The number and configuration of the shafts 20, 22 may vary in other embodiments. The shredder 10 also includes a lubrication system 50 (see FIG. 2) configured to lubricate the cutter elements 25, 27. The lubrication system 50 will be described in more detail later.

Generally speaking, shredder 10 may have any suitable construction or configuration and the illustrated embodiment is not intended to be limiting in any way. For example, the present invention may be incorporated into Model C-425Ci Powershred 0 shredders available from Fellowes, Inc., of Itasca, Ill., or any other type of shredder. In addition, the term "shredder" is not intended to be limited to devices that literally "shred" documents and articles, but is instead intended to cover any device that destroys documents and articles in a manner that leaves each document or article illegible and/or useless. For example, the lubrication system 50 may be used in disintegrators, or other devices.

The shredder 10 includes the shredder housing 41, mentioned above. The shredder housing 41 includes a top cover 11, and a bottom receptacle 14. It is contemplated that in some embodiments, the sub-frame 21 may serve as a bottom receptacle and a separate bottom receptacle 14 may be omitted. In this embodiment, the shredder housing 41 includes the top cover or wall 11 that sits atop the upper periphery of the bottom receptacle 14. The top cover or wall 11 is molded from a plastic material or any other material. The shredder housing 41 and its top wall or cover 11 may have any suitable construction or configuration. The top cover or wall 11 has an opening, which is often referred to as the throat 38, extending generally parallel and above the cutter elements. The throat 38 enables the articles being shredded to be fed into the cutter elements.

The shredder 10 includes the bottom receptacle 14 having a bottom wall, four side walls and an open top. The bottom receptacle 14 is molded from a plastic material or any other material. The bottom receptacle 14 sits atop the upper periphery of the bottom housing 16 in a nested relation using flange portions of the bottom receptacle 14 that generally extend outwardly from the side walls thereof. In embodiments where the separate bottom receptacle is eliminated, the shredder mechanism 17 may directly sit atop the upper periphery of the bottom housing 16. In the embodiment shown in FIG. 1, the shredder mechanism 17 along with the motor 13, and the detector 43 are configured to be received in the bottom receptacle 14 of the shredder housing 41. The bottom receptacle 14 may be affixed to the underside of the top cover or wall 11 by fasteners. The receptacle 14 has an opening in its bottom wall through which the shredder mechanism 17 discharges shredded articles into the container 15.

In the illustrated embodiment, the shredder 10 sits atop the large freestanding housing 16, which is formed of molded plastic material or any other material. The housing 16 includes a bottom wall, three side walls, an open front and an open top. The side walls of the container 16 provide a seat on which the shredder housing 41 is removably mounted. The housing 16 is constructed and arranged to receive the waste container 15 therein. In other words, the waste container 15 is enclosed in the housing 16. The waste container 15 is formed of molded plastic material or any other material. The waste container 15 is in the form of a pull-out bin that is constructed and arranged to slide in and out of the housing 16 through an opening in the front side thereof. The waste container 15 is configured to be removably received within the housing 16. The waste container 15 includes a bottom wall, four side walls, and an open top. The waste container 15 includes a handle 19 that is configured to allow a user to grasp and pull out the waste container 15 from the housing 16. In the illustrated embodiment, the handle 19 is located on the front, side wall of the waste container 15. Any construction or configuration for the housing or waste container may be used, and the illustrated embodiment is not limiting. The shredder 10 may optionally be provided with roller members 24, such as wheels or casters, that facilitate the transport of the shredder 10 from one place to another The cover 11 may include a switch recess with an opening therethrough. An on/off switch that includes a switch module may be mounted to the top cover 11 underneath the switch recess by fasteners, and a manually engageable portion that moves laterally within the switch recess. The switch module has a movable element that connects to the manually engageable portion through the opening. This enables movement of the manually engageable portion to move the switch module between its states.

The switch module is configured to connect the motor 13 to the power supply. This connection may be direct or indirect, such as via a controller. Typically, the power supply will be a standard power cord with a plug on its end that plugs into a standard AC outlet. The switch is movable between an on position and an off position by moving the manually engageable portion laterally within the switch recess. As an option, the switch may also have a reverse position wherein contacts are closed to enable delivery of electrical power to operate the motor 13 in a reverse manner. The capability to operate the motor 13 in a reverse manner is desirable to move the cutter elements in a reversing direction for clearing jams.

The detector 43 may be activation sensors that are activated when the sensors detect articles that are inserted into the throat 38. When the switch is in its on (or idle) position, the controller may be configured to operate the motor 13 to drive the cutter elements 25, 27 of the shredder mechanism 17 in the shredding direction when the detector 43 detects the presence or insertion of the articles to be shredded. Having the detectors 43 activate the shredder 10 is desirable because it allows the user to ready the shredder 10 by moving the switch to its on position, but the controller will not operate the shredder mechanism 17 to commence shredding until the sensors detect the presence or insertion of one or more articles in the throat 38. Once the articles have passed into the shredder mechanism 17 beyond the detector 43, the controller will then stop the movement or rotation of the cutter elements 25, 27 of shredding mechanism 20, as that corresponds to the articles having been fully fed and shredded. The use of such sensors to activate the shredder mechanism 20 is beneficial because it allows the user to perform multiple shredding tasks without having the shredder mechanism 20 operating, making noise, between tasks. It also reduces wear on the shredder mechanism 20, as it will only operate when substrates are fed therein, and will not continually operate. In some embodiments, the detector 43 may also be a thickness detector configured to detect thickness of the articles inserted into the throat 38.

FIG. 2 shows a detailed view of an embodiment of the shredder mechanism 17 comprising the first and second rotatable shafts 20, 22. First and second rotatable shafts 20, 22 are each provided with a plurality of cutter elements 25 and 27, respectively. The cutter elements 25 and 27 are provided on each of the shafts 20, 22 such that the cutter elements 25, 27 on each shaft interleave with each other. In an embodiment, at least a portion of cutter elements 25 and 27 have a radial projection thereon to shred or destroy articles fed between the shafts. The radial projections may include cross cutting teeth (not shown). As known in the art, the use of cross cutting teeth on cutter elements 25, 27 allows for shredding of the article into small chips rather than long strips. In another embodiment, the cutter elements 25, 27 comprise radial bumps or protrusions along their periphery to aid in destroying the substrates, either alone or in cooperation with projections, such as cross cutting teeth. Further, it is envisioned in another embodiment that the cutter elements have any shape or configuration, and may be sloped with undulating surfaces to create shaped paper shreds (e.g., diamond shapes or chips). However, it should be noted that the radial profile of the projections should not be limited, and the cutter elements may include any known configuration for paper cutting. For example, in one embodiment, it is envisioned that the cutter elements may be designed for strip cutting by interleaving with one another such that they cooperate to shear articles or substrates in the feeding direction between the cutters, to thus create long strips of paper. As is well known, strip cutter elements do not have cutting teeth for transversely cutting the article strips, unlike cross cutter elements that do.

As shown in FIG. 2, the drive system 28 includes a first gear member or sprocket 54 configured to operate a chain member 52. A second gear member or sprocket 56 is operatively connected to the first shaft 20. In the illustrated embodiment, the sprockets 54, 56 may be provided near or on the first side 61 of the sub-frame 21. The chain member 52 is passed around the sprockets 54, 56 such that the rotation of sprocket 54 by the drive system 28 causes the rotation of sprocket 56 via the chain member 52. The second shaft 22 may be operatively connected to gears (not shown) that interact with the second sprocket 56 such that rotation of the first shaft 20 also causes rotation of the second shaft 22. It is contemplated that in other embodiments, each shaft 20, 22 may be independently rotated by the drive system 28.

In some embodiments, the first and second rotatable shafts 20 and 22 are designed to be coupled to the drive system 28 (e.g., motor 13) such that the shafts are counter-driven in respective, opposite rotational cutting directions. First rotatable shaft 20 may be rotated in a clockwise direction and second rotatable shaft 22 may be rotated in a counter-clockwise direction, such that the cutter elements 25 of first rotatable shaft 20 interleave with the cutter elements on second rotatable shaft 22. When articles are inserted into the throat 38 and into path 60, shafts 20, 22 are positioned to be rotationally counter-driven by motor 13 in a rotational cutting direction, and the article is fed between first and second rotating shafts 20 and 22 and their corresponding cutter elements 25 and 27. As the cutter elements 25 and 27 interleave with each other, they are configured to cooperate to shred the articles fed therebetween through the throat 38, and drive such down through paper path 60 defined between the shafts 20, 22.

Figure 3:
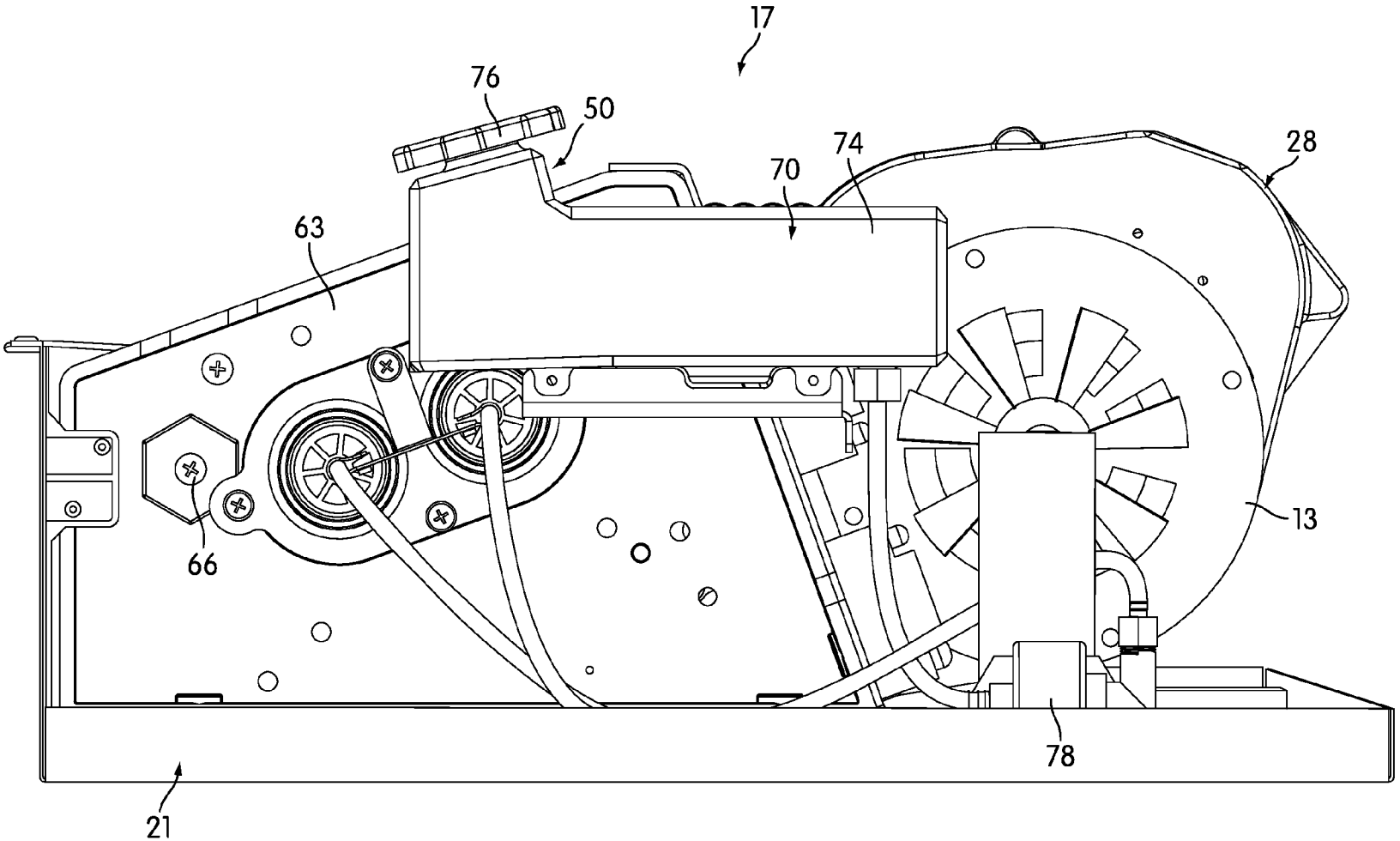
FIG. 3 is side view of the shredder mechanism with lubrication system of FIG. 2.

The shredder mechanism 17 may also include strippers 62, 64 that correspond with first and second shafts 20, 22, respectively. Rods 58, 59 may be located above the shafts 20, 22 and the strippers 62, 64. In one embodiment, each set of strippers 62, 64 has an array of engaging members with spaces therebetween to receive portions of the cutter elements 25, 27 such that the cutter elements 25, 27 are interleaved with the engaging members of the strippers 62, 64. The strippers 62, 64 may be provided to strip away the shredded article as it is fed through the interleaving cutter elements 25 and 27. That is, the strippers 62, 64 may prevent the cut article from winding up on the shafts during rotation. This prevents clogging of the cutting area and the shredder mechanism 17 from jamming. As shown in FIGS. 2-3, the stripper 62 may be fixed to the sub-frame 21 via screws 66, although other attachment mechanisms may be used. Stripper 64 may be fixed to the sub-frame 21 in a similar manner. Strippers 62, 64 are designed to work in cooperation with the cutter elements on a rotating shaft (i.e., cutter elements 25 on the first shaft 20 and cutter elements 27 on the second shaft 22), and do not rotate or move in relation to the rotating shaft. While some relative motion between components of the strippers 62, 64 and the rotating shafts 20, 22 may be permitted, the overall structure as a whole remains stationary and do not move in cooperation with the rotating shafts 20, 22.

Figure 11:
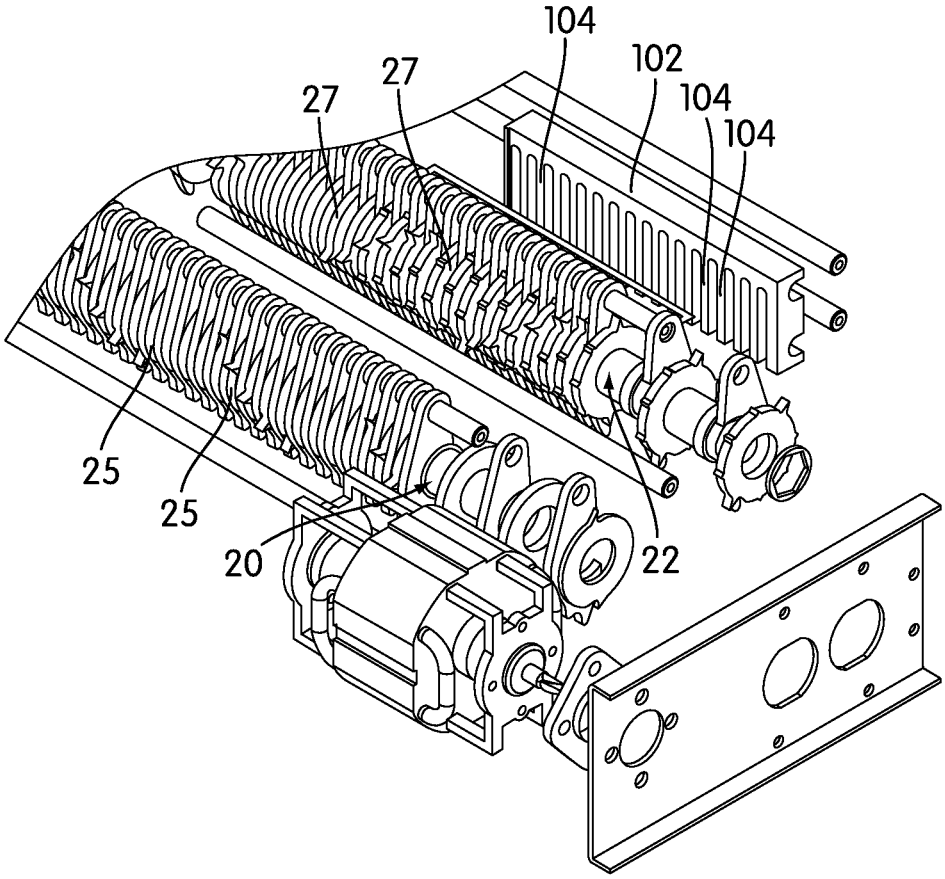
FIG. 11 is an exploded view of a stationary structure and shafts of a shredder in accordance with an embodiment.

In some embodiments, the shredder may be provided with a stationary structure 102 (see FIG. 11) having fixed engaging members 104 constructed and arranged to interleave with the cutter elements 25 or 27. Because these fixed engaging members 104 cooperate with the cutter elements 25, 27 (at least in the stripping direction) they may be referred to as the cutter elements as well. In one embodiment, one of the shafts 20, 22 may be associated with a stationary structure 102. The stationary structure 102 and the shafts 20, 22 may be positioned such that the substrates fed into the throat 38 are received between the stationary structure 102 and one of the shafts 20, 22 to shred the substrates. The stationary structures 102 may be of the type described in U.S. Pat. No. 7,677,483. Accordingly, in some embodiments having the stationary structure 102, only one shaft 20 or 22 is provided to shred the articles. Alternatively, in some embodiments having the stationary structure 102, both shafts 20, 22 may be provided. That is, the articles can be shred between the shafts 20, 22 or between the stationary structures 102 and one of the shafts 20, 22. Thus, the shredder mechanism 17 may have a pair of cooperating structures in the form of two rotatable motor-driven shafts with interleaving sets of cutter elements or one such rotatable motor driven shaft and a stationary structure with interleaving sets of cutter elements.

Figure 4:
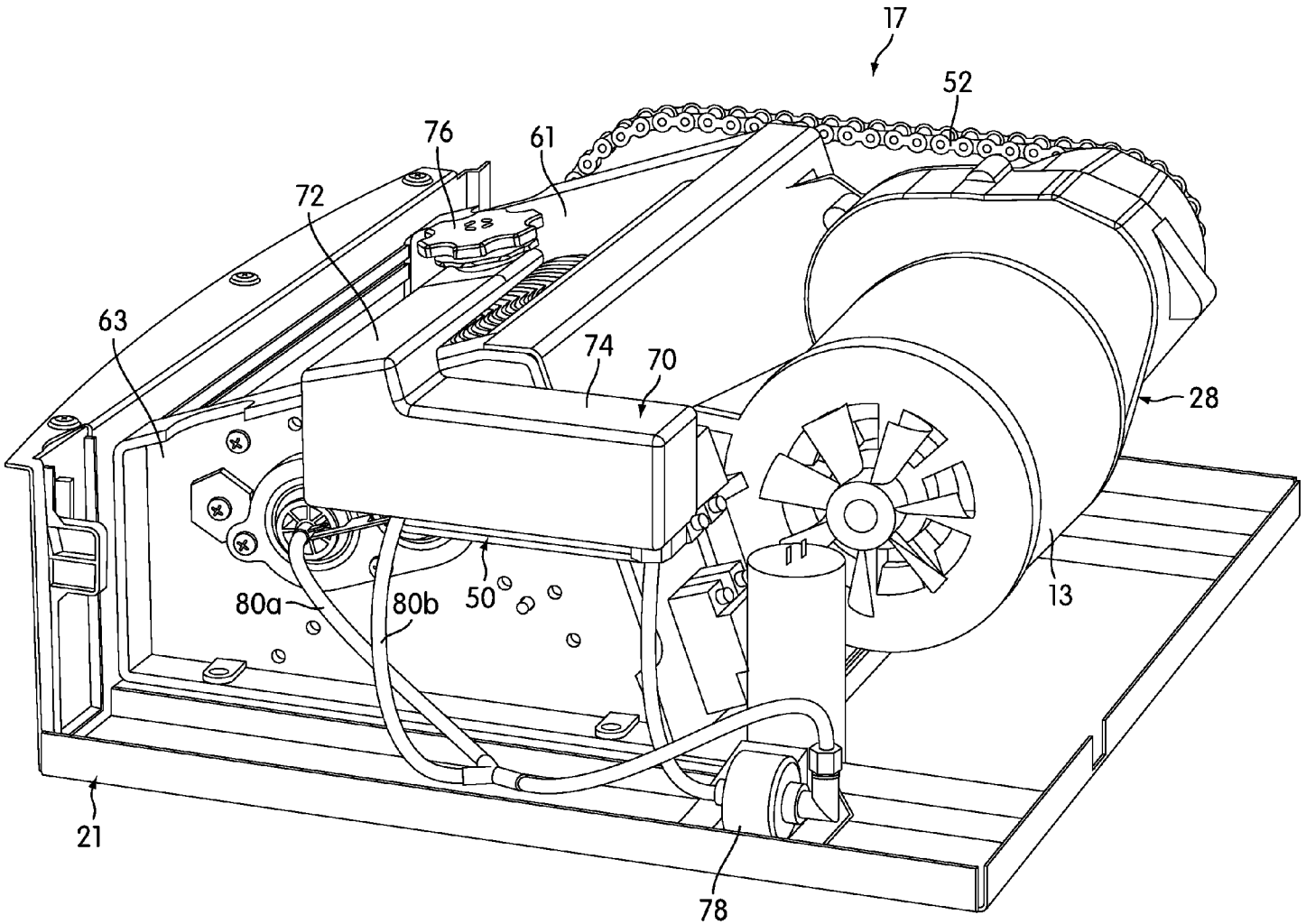
FIG. 4 is perspective side view of the shredder mechanism with lubrication system of FIG. 2.
Figure 5:
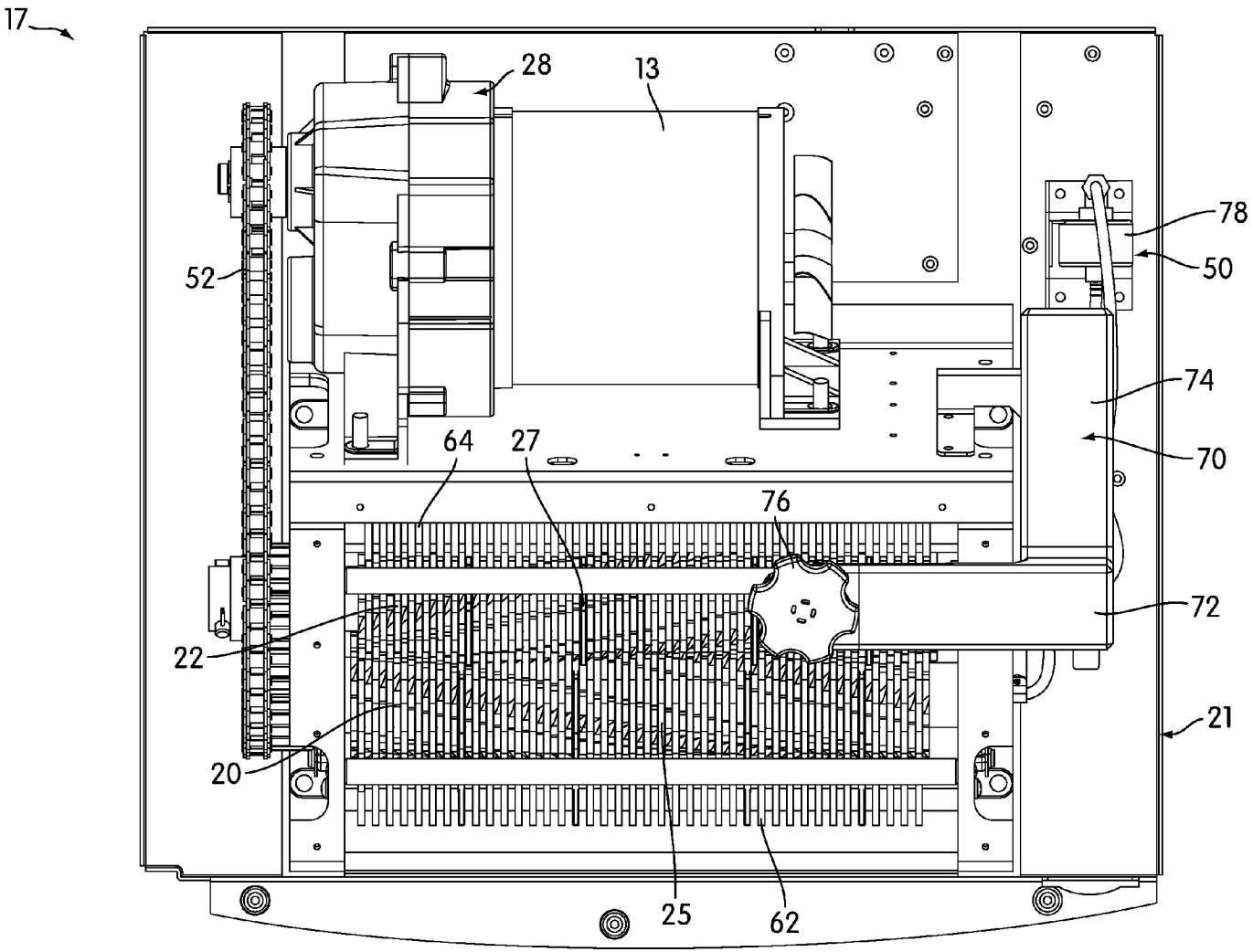
FIG. 5 is a top view of the shredder mechanism with lubrication system of FIG. 2.

As shown in FIG. 2, the lubrication system 50 is provided with the shredder mechanism 17. The lubrication system 50 includes a reservoir 70 constructed and arranged to hold a supply of lubricant, such as oil. The reservoir 70 may be attached to the side 63 of the sub-frame 21. The L-shaped reservoir 70 may be defined by a first portion 72 and a second portion 74. In the illustrated embodiment, the first portion 72 extends over at least a portion of the shaft 22 and includes a cap 76 provided thereon. The cap 76 may cover an opening (not shown) that communicates with an interior space of the reservoir 70. The location of the cap 76 in this embodiment enables the cap 76 to be easily accessible when the lubrication system 50 is to be refilled. In this embodiment, to refill the reservoir 70 with lubricant, the cap 76 should be removed to access the opening. In some embodiments, the reservoir 70 may be replaced rather than re-filled. An optional sensor 85 may be provided on the reservoir 70 to detect the level of the lubricant in the reservoir 70. In some embodiments, at least a portion of the sensor 85 may be received in the reservoir 70 to detect the level of the lubricant. In some embodiments, the sensor 85 may be operatively connected to an indicator configured to generate a warning indication in the form of a light or other signals when the level of the lubricant is low and the lubrication system 50 should be refilled. Accordingly, lubrication may be poured into the lubrication system 50 after the cap 76 has been removed. The illustrated lubrication system 50 is not intended to be limiting, and it is contemplated that the reservoir 70 may have other shapes and/or may be located in other areas. FIG. 3 shows a side view of the shredder 10 with the lubrication system 50. FIG. 4 shows a perspective side view of the shredder 10 with the lubrication system 50. FIG. 5 shows a top view of the shredder 10 with the lubrication system 50.

Figure 6:
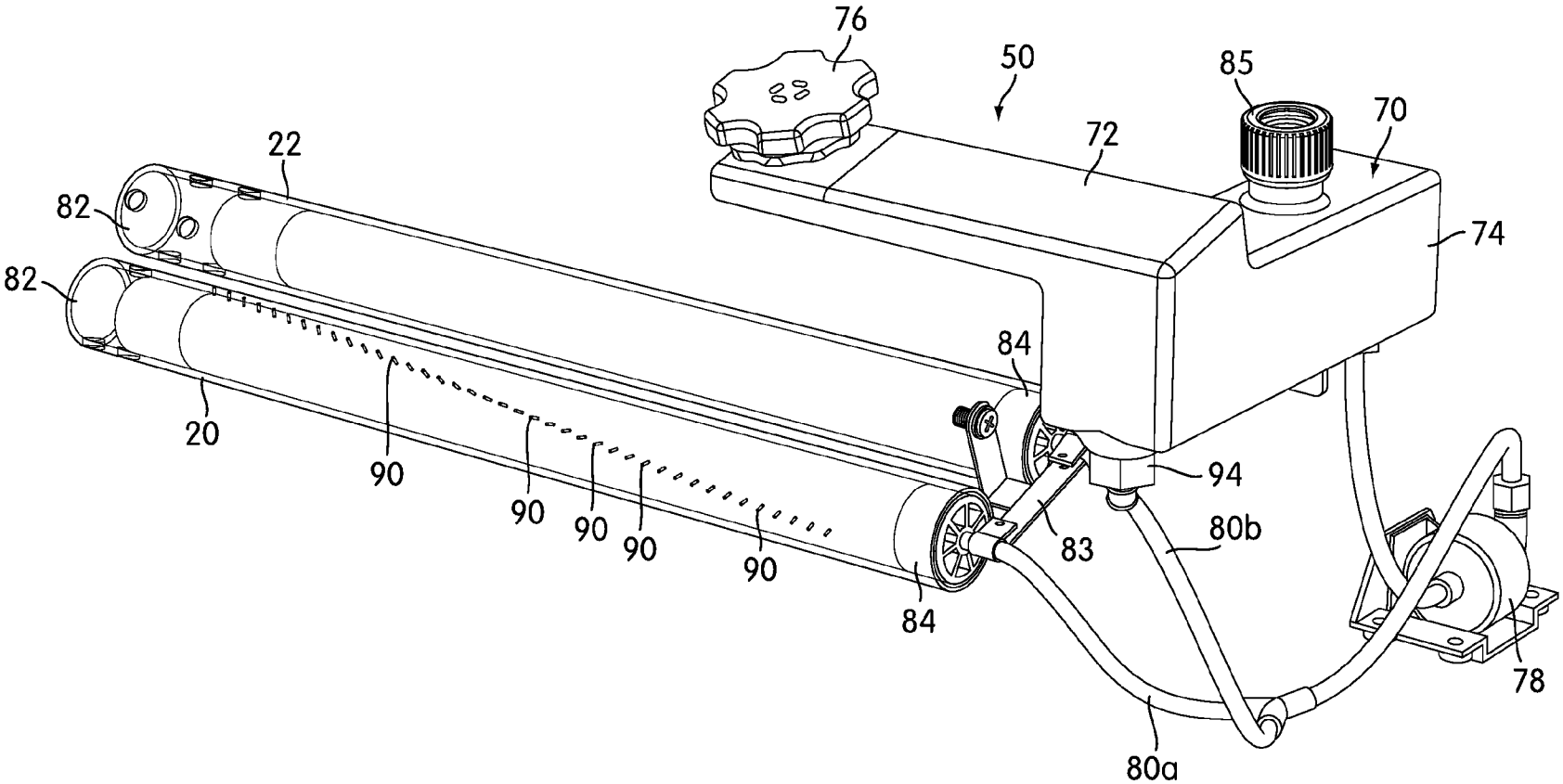
FIG. 6 is a perspective view of the lubrication system in accordance with an embodiment.

FIG. 6 shows a perspective view of the lubrication system 50. The lubrication system 50 includes a pump 78 that draws lubricating fluid from the reservoir 70. The pump 78 may communicate with conduits or tubes 80*a*, 80*b* to distribute lubricant to the cutter elements 25, 27 on the shafts 20, 22. In the illustrated embodiment, conduit 80*a* communicates lubricant to the cutter elements 25 on shaft 20, and conduit 80*b* communicates lubricant to the cutter elements 27 on shaft 22. The conduits 80*a*, 80*b* are supported on a support structure 83 constructed and arranged to be attached to the second side 63 of the sub-frame 21, as shown in FIG. 2. It is contemplated that the number of conduits may vary in other embodiments. For example, in one embodiment, at least two conduits may be associated with each shaft 20, 22 to communicate lubricant to the cutter elements 25, 27.

The pump 78 may be operatively connected to the controller, which may be programmed with instructions for determining when to lubricate the cutter elements 25, 27. The term "controller" may be used to refer to any device that controls operation of a component of the shredder 10. For example, a controller may be a device or microcontroller having a central processing unit (CPU) and input/output devices that are used to monitor parameters from devices that are operatively coupled to the controller. The input/output devices also permit the CPU to communicate and control the devices (e.g., such as a sensor or the motor 13) that are operatively coupled to the controller. As is generally known in the art, the controller may optionally include any number of storage media such as memory or storage for monitoring or controlling the sensors coupled to the controller. In some embodiments, a controller may be a conventional circuit with no processor, and may comprise one or more binary switches or a relays. The controller may optionally comprise a processor. In some embodiments, the controller may be circuitry configured to activate or operate components of the shredder 10 in accordance with logic, rules, and/or software. In an embodiment, the controller may process the instructions and subsequently apply them by activating the pump 78. The pump 78 may be activated at certain times or intervals, at user selected times, or may be continuously activated. The controller may be programmed to operate the pump 78 in a number of different modes. In one embodiment, the controller is programmed to operate according to a predetermined timing schedule. In another, the controller activates the pump 78 upon a certain number of rotations of the drive for the cutter elements 25, 27. In another embodiment, the detector 43 monitors a thickness of items deposited into the throat 38. Upon accumulation of a predetermined total thickness of material shredded, the controller activates the pump 78 to lubricate the cutter elements 25, 27. It is also possible to schedule the lubrication based on a number of uses of the shredder 10 (e.g., the controller tracks or counts the number of shredding operations and activates the pump after a predetermined number of shredder operations). In each of the embodiments making use of accumulated measures, a memory can be incorporated for the purpose of tracking use. In each foregoing embodiment, the shredder 10 may include a manual control to allow a user to operate the system outside of the schedule determined by the controller. The shredder 10 can include any of these and other features described in U.S. Pat. No. 7,798,435, which is incorporated herein in its entirety.

As shown in FIG. 6, the lubrication system 50 may optionally include a lubricant drain port 94 that enables lubricant to be drained from the lubrication system 50. This may be useful when the lubrication system 50 is to be cleaned or the lubricant is to be replaced.

Figure 7:
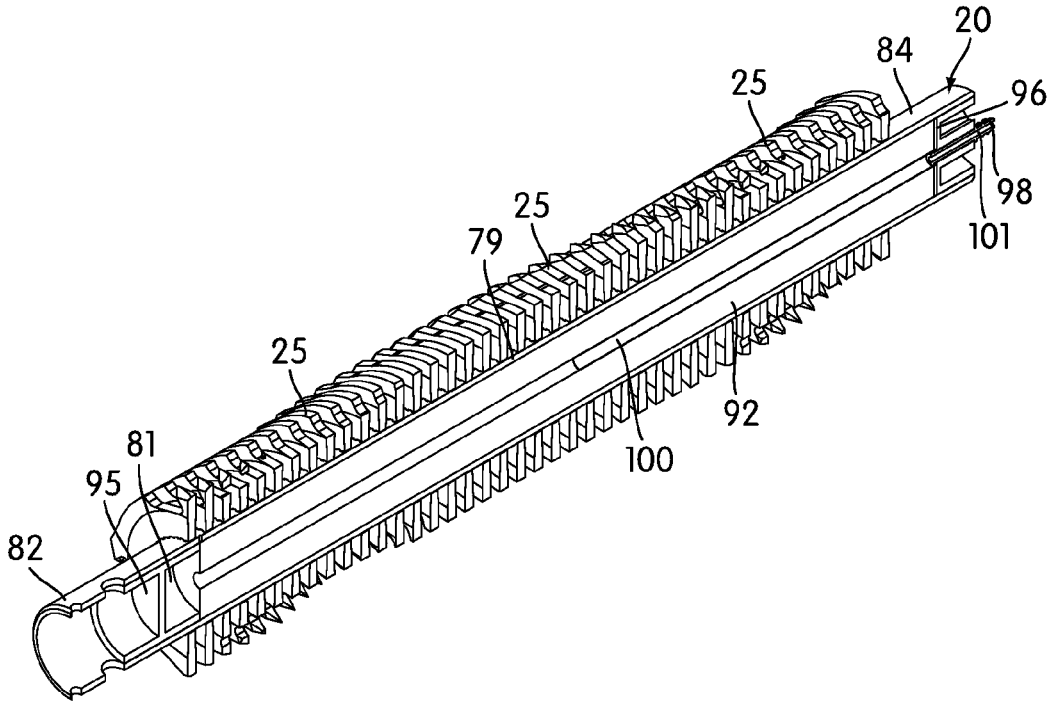
FIG. 7 is a cross-sectional view of a shaft with cutter elements of the shredder mechanism in accordance with an embodiment.
Figure 8:
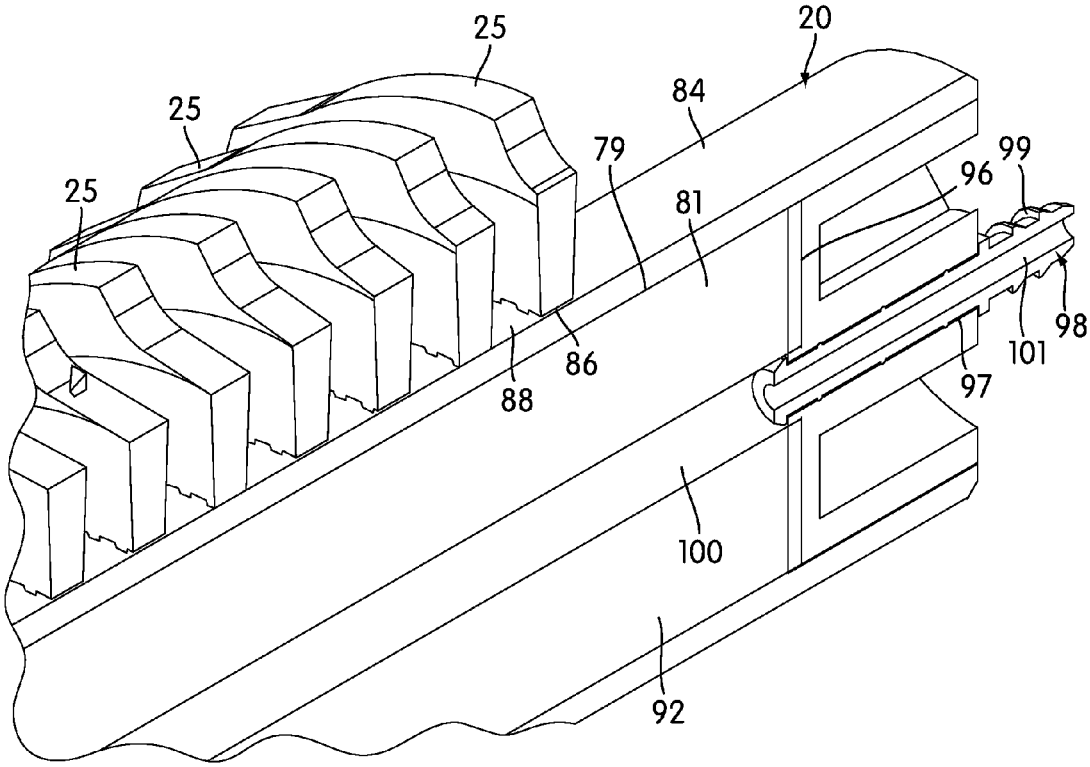
FIG. 8 is a detailed cross-sectional view of a portion of the shaft of FIG. 7.
Figure 10:
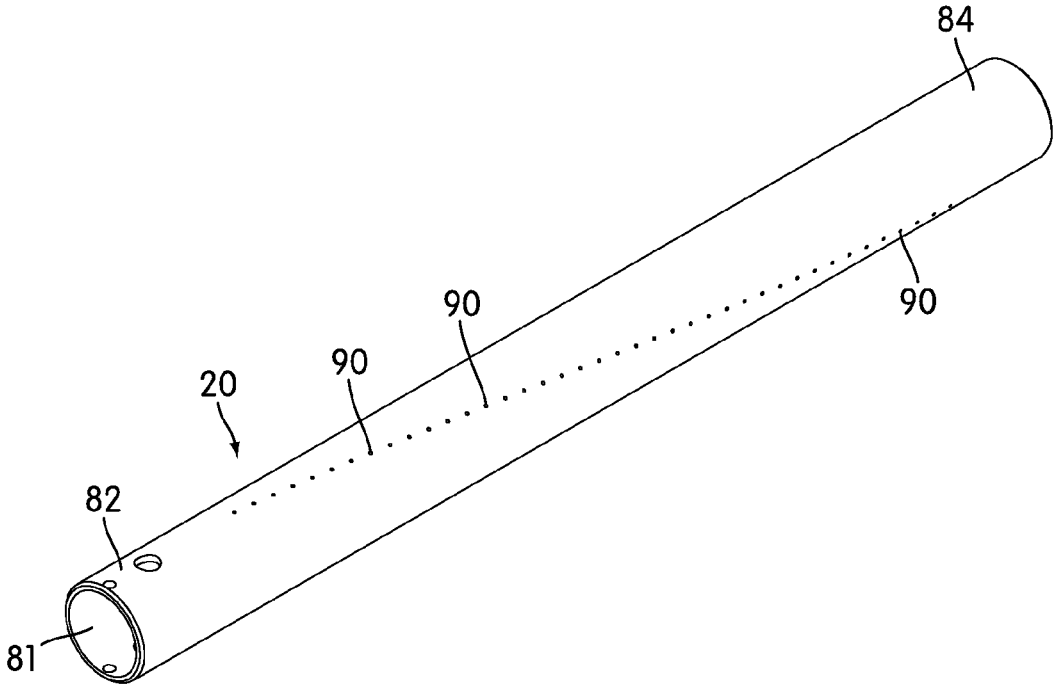
FIG. 10 is a perspective view of the shaft of FIG. 7.

In some embodiments, the shafts 20, 22 may function as lubricant distribution manifolds. In the embodiment shown in FIG. 6, the shafts 20, 22 are provided with a plurality of openings 90 configured to enable lubricant to flow therethrough to lubricate the cutter elements 25, 27. The openings 90 are arranged in a helical path along the shafts 20, 22 so as to minimize residual oil flow when the shredder 10 is not in use. This arrangement is not intended to be limiting, and the openings 90 may be arranged in other configurations or arrangements in other embodiments. The shafts 20, 22 may be hollow shafts as described in U.S. Pat. No. 5,961,058, which is incorporated herein in its entirety. As shown in FIGS. 7 and 10, the shaft 20 is a hollow cylindrical tube with a first end 82 and a second end 84 spaced from the first end 82. An inner surface 79 of the shaft 20 defines a hollow interior space 81 therewithin. As shown in FIG. 8, the shaft 20 has a first alternating outer surface portion 86 and a second alternating outer surface portion 88, the first alternating surface portion 86 and the second alternating outer surface portion 88 defining the outer surface of the shaft 20. The first alternating outer surface portion 86 lines the inner surfaces of the cutter elements 25 so that the cutter elements 25 are fixedly mounted to the shaft 20. The second alternating outer surface portion 88 is between the cutter elements 25, and preferably may have an outer diameter that is greater than the inner diameter of the adjacent cutter element 25. As a result, the cutter elements 25 are restrained from substantial lateral movement along the shaft. The openings 90 may be formed through the tubular shaft 20 open to the inner 79 and alternating outer surface portions 86, 88. The configuration and arrangement of the shaft 22 may be similar to the shaft 20.

During manufacture, the shaft 20 may be expanded from a consistent external diameter to achieve the configuration and arrangement described above. The shaft 20 may be expanded outward against and around the inner surfaces of the cutter elements 25, as is shown in U.S. Pat. No. 5,799,887, the entirety of which is incorporated herein by reference. In some embodiments, the inner surfaces of the cutter elements 25 may be provided with teeth or other structures that enable the cutter elements 25 to grip or lock onto the shaft 20 after the shaft 20 has been expanded. The shaft 20 may be expanded in a number of different ways. For example, the shaft 20 is expanded by pumping a hydraulic fluid such as water through the shaft with a high amount of pressure. The amount of pressure used depends on the size, thickness, and material of the shaft being expanded. As an illustrative example, water may be pumped through a 0.5 inch steel shaft having a 0.035 inch thick wall at a pressure of about 18,000 pounds per square inch.

The shaft 20 may also be expanded by driving a mandrel or a ball bearing through the shaft 20. The mandrel and ball bearing would have an outer diameter greater than the inner diameter of the shaft 20, but smaller than the inner diameter of the cutter elements 25. As a result, the mandrel or ball bearing would expand the shaft outward against and around the inner surfaces of the cutter elements 25 as the mandrel or ball bearing passes through the hollow shaft 20. The mandrel or ball bearing could be driven through the hollow shaft 20 by hydraulic, pneumatic, or explosive pressure, mechanical jacking, or any other suitable means that can apply the requisite force. After expanding the shaft, the mandrel, or a portion thereof, may also be left inside the hollow shaft 20 to provide extra support for the shaft 20.

As a result of the expansion, the outer surface of the shaft 20 lines the inner surface of the cutter elements 25 so that cutter elements 25 are fixed from substantial rotation about the expanded shaft 20 as well as from substantial lateral movement along the expanded shaft 20. Accordingly, once the shaft 20 is expanded, it becomes the shaft 20 described above with the first and second alternating outer surface portions 86, 88.

The shaft 20 may have a circular cross-section, although it is conceivable that the shaft could have a cross-section with a variety of different geometric configurations. Additionally, the shaft 20 may be made out of any desirable material, such as aluminum, steel, or plastic, that has good strength and ductility. The shaft may be made out of steel that is relatively softer than the material used for the cutter discs. As a result, the shaft will expand under applied force or pressure before the cutter discs. It is also contemplated that a driving gear (not shown) may be fixed to the shaft 20 in a similar manner as the cutter elements 25. Alternatively, the driving gear may be separately attached thereon.

In some embodiments, the shaft 20 may be a porous metal tube that is constructed by isostatically pressing powdered metal in molds, thus resulting in a seamless tube structure. The tube structure may then be sintered to form a rigid porous filter tube that may be used as a lubricant distribution manifold.

The configuration and arrangement of the second shaft 22 may be similar to the first shaft 20 described above. The second shaft 22 may also be made in a similar manner.

Figure 9:
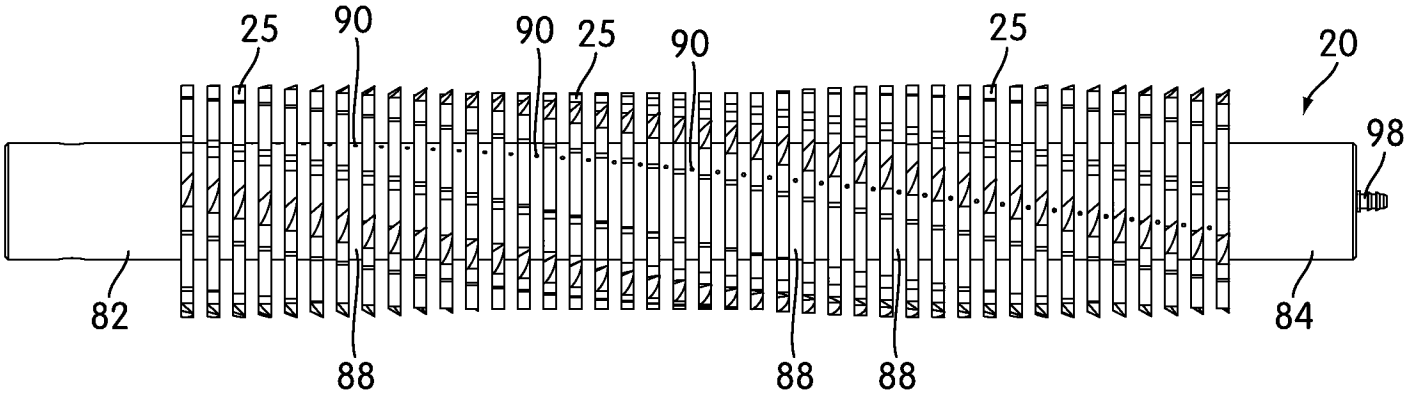
FIG. 9 is a top view of the shaft with cutter elements of FIG. 7.

As shown in FIG. 9, the openings 90 are arranged in a helical path along the shafts 20 and are located between each cutter element 25, 27 so as to deliver lubricant directly to high friction areas. In this embodiment, the openings 90 are arranged on the second alternating outer surface portions 88 of the shaft 20. However, it is contemplated that this example is not intended to be limiting, and the openings 90 may be arranged in other patterns and/or locations. In some embodiments, the openings 90 can have a diameter of up to 1 mm. However, the openings 90 may optionally be larger or smaller depending on the amount of oil needed, manufacturing constraints, cost constraints, and other factors. =The helical arrangement of the openings 90 may result in no openings or very few openings being aligned in the axial direction of a shaft, thus resulting in a stronger shaft. Furthermore, the helical arrangement of the openings 90 may reduce the number of openings that are facing downwards at any given time such that the amount of oil seeping therethrough due to gravity is minimized when the shredder 10 is not in operation. Accordingly, such helical arrangements of the openings 90 may prevent waste of lubrication. In some embodiments, it is also contemplated that cutting shaft position sensors (not shown) may be used to prevent or minimize waste of lubrication. In such embodiments, the cutting shaft position sensors may be configured to sense the rotational position of the cutting shafts 20, 22 and the openings 90 so as to enable the shredder 10 to cease operation with all or most of the openings 90 facing upwards. Accordingly, when the shredder 10 is not in operation, the amount of oil that seeps through the openings 90 due to gravity is minimized.

FIG. 8 shows a detailed cross-section of the shaft 20. The shaft 22 may have a similar configuration as the shaft 20. In this embodiment, a filler material 92 is provided in the hollow space 81 of the shaft 20, and at least a portion of the filler material 92 may contact the inner surface 79 of the shaft 20. The filler material 92 will be described in more detail later. The shaft 20 also includes an end structure 96 provided therein. The end structure 96 may be provided on the second end 84 to retain the filler material 92 within the shaft 20. Similarly, an end structure 95 (see FIG. 7) may also be provided on the first end 82 to retain the filler material 92 within the shaft 20. As shown in FIG. 8, the end structure 96 includes an opening 97 constructed and arranged to receive an lubricant receiving structure 98 having a recess 101. The lubricant receiving structure 98 may be connected to the conduit 80*a* (see FIG. 2) such that lubricant may enter the shaft 20 through the recess 101 of the lubricant receiving structure 98. A portion of the lubricant receiving structure 98 may be received in the conduit 80*a*. In one embodiment, ridges 99 may be provided on the surface of the lubricant receiving structure 98 to facilitate and retain the connection between the lubricant receiving structure 98 and the conduit 80*a*. The shaft 22 may have a similar configuration and arrangement as the shaft 20 and may be connected to conduit 80*b* in a similar manner.

As shown in FIG. 8, the filler material 92 surrounds a delivery tube 100. In some embodiments, the delivery tube 100 may be an extension of the lubricant receiving structure 98. The delivery tube 100 may be integral with the lubricant receiving structure 98 or may be a separate component attached to and in communication with the recess 101 of the lubricant receiving structure 98. The delivery tube 100 may be made of clear plastic material, or other materials. The delivery tube 100 may be used to deliver the lubricant closer to the center of the shaft 20, thus avoiding saturation on one side of the shaft 20. In some embodiments, the delivery tube 100 may be used to conduct lubricant to central portion axially. The lubricant can then wick radially and axially through the filler 92 to reach the openings 90 provided along the length of the shaft 20. As such, the length of the delivery tube 100 may be about half the length of the filler material 92 in the shaft 20, as shown in FIG. 7. In some embodiments, the delivery tube 100 may be a coating and/or may be made of materials less porous than the filler 92 such that the lubricant travels faster to the center (i.e., axially) than through the fillers 92 (i.e., radially). However, it is contemplated that in some embodiments, the delivery tube 100 may be eliminated and the oil may be directly communicated from the lubricant receiving structure 98 to the filler material 92.

The filler material 92 is a lubricant permeable material. It may be open cell foam, such as, just for example, open cell polyurethane foam. The filler material 92 may also be fillers, such as pellets, sand, porous materials, or any other material that allows the lubricant to permeate therethrough and delays the release of the lubricant through the openings 90. In such embodiments, the lubricant may saturate the filler material 92 before the lubricant can exit the openings 90 to lubricate the cutter elements 25. Thus, the filler materials 92 can be disposed in the hollow space 81 of the shaft 20 for slow and even lubricant delivery. The type of material used as the filler material 92 may affect the rate at which lubricant seeps from the delivery tube 100 to the openings 90, and thus the type of material used as filler material 92 may be dependent on the desired rate of release of the lubricant.

The arrangement of the openings 90 and the use of the filler materials 92 enable lubricant to be delivered to areas requiring the most lubrication efficiently such that less lubricant is required to effectively lubricate the cutter elements 25, 27. For example, these areas may include the portions of the cutter elements 25, 27 that contact the articles to be shredded more often than other portions of the cutter elements 25, 27, such that they are subject to constant wear. In some embodiments, the shafts 20, 22 may be constructed and arranged to function similarly as a "soaker hose." That is, openings 90 may be provided along the shaft 20 such that the lubricant may seep or drip from the openings 90 in the shafts 20, 22 to reach the cutter elements 25, 27. This may efficiently and effectively lubricate the cutter elements 25, 27 while minimizing waste of lubricant. As mentioned above, the openings 90 may be provided in a helical pattern along the shaft 20, as shown in FIG. 10. In such embodiment, each opening 90 may be provided at a second alternating outer surface portion 88, as shown in FIG. 9, so that the openings 90 are provided between the cutter elements 25. In some embodiments, the openings 90 may be arranged between each cutter elements 25, 27. In such embodiments, the arrangement of the openings 90 enable oil to be delivered to high-friction areas between the cutter elements 25, 27 and the strippers 62, 64. In some embodiments, the openings 90 may be aligned axially along the shaft 20. In other embodiments, the openings 90 may be provided at various locations along the shaft 20. As mentioned above, the shaft 22 may have a similar configuration and arrangement as the shaft 20.

The lubrication used by the lubrication system 50 can be solid or fluid (liquid). In some embodiments, the solid lubricants can be placed inside the hollow space 81 of the shafts 20, 22. For example, in one embodiment, a disposable cardboard cartridge holding a solid lubricant can be placed in the hollow space 81 of the shaft 20. In some embodiments, the disposable cardboard cartridge may be used to facilitate the insertion of the solid lubricant into the hollow space 81 of the shaft 20 and then withdrawn from the shaft 20 after the lubricant has been inserted therein. In some embodiments, the disposable cardboard cartridge may be provided with openings that enable the solid lubricant to flow radially outwards therefrom towards the openings 90 of the shaft 20 after the solid lubricant has been heated. The solid lubricant may be vegetable shortening or grease. Alternatively, paraffin or other types of lubricants may be used. In some embodiments, the cartridge may be similar to the grease cartridges known in the art that are used with grease-injector guns. Examples of these cartridges include, but not are not limited to, Lubriplate® Grease Cartridges, Mobil® 1 Synthetic Universal Grease Cartridge, and others. The supply of lubricant can be a reservoir of lubricant or a source of lubricant external to the shafts 20, 22 or the supply of lubricant can be a reservoir of lubricant or a source of lubricant in the interior space 81 of the shafts 20, 22. For example, in embodiments using liquid lubricant, the reservoir 70 may hold a first supply of lubricant, and the interior of the shaft may also hold a second supply of lubricant after the lubricant has been delivered to the shafts 20, 22 from the reservoir 70.

In embodiments using solid lubricants, the solid lubricant can be formulated to melt at a specific temperature (e.g., 60° C. to 70° C. or any other temperatures). Accordingly, the solid lubricant may melt when the shredder 10 is in operation. For example, heat generated by operation of the motor may melt the lubricant. In addition, friction between the strippers 62, 64 and the cutter elements 25, 27 may also melt the lubricant. In such situations, pro-longed or constant operation of the shredder 10 may result in increased friction, which generates more heat. This increased heat may melt the solid lubricant and result in a coating of oil on the cutting shafts 20, 22. The coating of oil may reduce friction, and the heat from the friction may be reduced as a result. This reduction in heat then results in less solid lubricant being melted. However, the amount of solid lubricant being melted may increase again after friction is increased due to prolonged or constant use of the shredder 10. Accordingly, the amount of friction may determine the amount of solid lubricant being melted. Thus, in some embodiments, the solid lubricant may melt when the shredder 10 has been heavily used (i.e., near the end of a duty cycle) and the heat generated by the shredder 10 may cause the solid lubricant to melt to lubricate the cutter elements 25, 27. Alternatively or additionally, an external heat element or source (not shown) may be used with the lubrication system 50 to release the lubricant on demand For example, in one embodiment, resistive heaters may be placed inside the shafts 20, 22 to heat the lubricants. Alternatively, the heat element may be placed in close proximity to the cutting shafts 20, 22. In some embodiments, the external heat source may apply sufficient heat at certain time intervals, random times, or user selected times, to melt the solid lubricant to lubricate the cutter elements 25, 27. In embodiments where the disposable cardboard cartridges are used, the pump 78 and the conduits 80*a*, 80*b* may be optional. However, it is contemplated that the lubrication system 50 may include any combination of the pump 78, the conduits 80*a*, 80*b*, the external heat source, and the cardboard cartridge to enable alternative forms of lubrication. In some embodiments, the shredder 10 may be provided with an oiling mechanism as described in U.S. Pat. No. 7,798,435, incorporated herein in its entirety, in addition to the lubrication system 50 described above to enable alternative forms of lubrication.

It is contemplated that the lubrication system 50 may be used with any type of shredders 10 and machines and are not limited to the embodiments described above.

While the principles of the invention have been made clear in the illustrative embodiments set forth above, it will be apparent to those skilled in the art that various modifications may be made to the structure, arrangement, proportion, elements, materials, and components used in the practice of the invention.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. A shredder for shredding substrates, comprising:

a housing;

a substrate receiving opening provided on the housing;

a shredder mechanism received in the housing and comprising a motor, a pair of cooperating shredding structures each having a set of spaced apart cutter elements interleaving with one another such that substrates fed through the substrate receiving opening are fed between the interleaved sets of cutter elements, at least one of the cooperating shredding structures including a rotatably mounted shaft rotatable by the motor with its cutter elements mounted in spaced apart relation with spaces therebetween;

the shredder mechanism enabling substrates to be shredded to be fed between the interleaved sets of cutter elements and the motor being operable to rotate the shaft in a shredding direction so that the cutter elements shred the substrates fed therein;

the shaft having a tubular body with an inner surface defining a hollow interior, an outer surface, and a plurality of openings formed through the tubular body open to the inner and outer surfaces, the openings being open to the spaces between the cutter elements on the shafts, a supply of lubricant communicating with the plurality of openings of the shaft so as to deliver the lubricant from the interior of the shaft to the cutter elements through the openings.

2. The shredder of claim 1, wherein the supply is contained within the hollow interior of the shaft.

3. The shredder of claim 1, wherein the shredder further comprises a heating element constructed and arranged to heat the lubricant to the predetermined temperature.

4. The shredder of claim 1, wherein the lubricant comprises vegetable shortening.

5. The shredder of claim 1, wherein the supply comprises a cartridge constructed and arranged to hold the lubricant.

6. The shredder of claim 1, wherein the supply of lubricant comprises a solid lubricant.

7. The shredder of claim 6, wherein the lubricant is delivered through the openings when the temperature of the lubricant in the supply of lubricant is above a predetermined temperature.

8. The shredder of claim 1, further comprising paraffin wax material disposed in the interior of the shaft.

9. The shredder of claim 1, wherein the supply of lubricant comprises a fluid lubricant.

10. The shredder of claim 1, wherein the openings are positioned between the cutter elements.

11. The shredder of claim 1, wherein the openings are arranged in a helical pattern along the shaft.

12. The shredder of claim 1, further comprising a porous material disposed in the interior of the shaft.

13. The shredder of claim 1, wherein the shaft comprises a lubricant receiving structure operatively communicating with the interior of the shaft, the lubricant receiving structure being constructed and arranged to enable lubricant to be delivered to the interior of the shaft.

14. The shredder of claim 13, wherein the lubricant receiving structure communicates with a delivery structure configured to enable fluid to flow axially towards the center of the shaft at a faster rate than radially towards the openings.

15. The shredder of claim 13, wherein the shaft is constructed and arranged such that after the lubricant is delivered to the interior of the shaft using the lubricant receiving structure, the lubricant flows radially and axially through the shaft to the openings.

16. The shredder of claim 1, wherein each of the cooperating shredding structures includes a rotatably mounted shaft each rotatable by the motor with its cutter elements mounted in spaced apart relations with spaces therebetween;

the motor being operable to rotate each shaft in a shredding direction so that the cutter elements shred the substrates therebetween, wherein each shaft has a tubular body with an inner surface defining a hollow interior, an outer surface, and a plurality of openings formed through the tubular body open to the inner and outer surfaces, the openings being open to the spaces between the cutter elements on each shaft;

the supply of lubricant communicating with the plurality of openings of the shaft so as to deliver the lubricant from the interior of each shaft to the cutter elements through the openings.

17. The shredder of claim 16, wherein the supply is contained within the hollow interior of the at least one of the shafts.

18. The shredder of claim 17, wherein the shredder further comprises a heating element constructed and arranged to heat the lubricant to the predetermined temperature.

19. The shredder of claim 16, wherein the lubricant comprises vegetable shortening.

20. The shredder of claim 16, wherein the supply comprises a cartridge constructed and arranged to hold the lubricant.

21. The shredder of claim 16, wherein the supply of lubricant comprises a solid lubricant.

22. The shredder of claim 21, wherein the lubricant is delivered through the openings when the temperature of the lubricant in the supply of lubricant is above a predetermined temperature.

23. The shredder of claim 16, further comprising paraffin wax material disposed in the interior of the at least one of the shafts.

24. The shredder of claim 16, wherein the supply of lubricant comprises a fluid lubricant.

25. The shredder of claim 16, wherein the openings are positioned between the cutter elements.

26. The shredder of claim 16, wherein the openings are arranged in a helical pattern along the at least one of the shafts.

27. The shredder of claim 16, further comprising a porous material disposed in the interior of the at least one of the shafts.

28. The shredder of claim 16, wherein the at least one shaft comprises a lubricant receiving structure operatively communicating with the interior of the at least one of the shafts, the lubricant receiving structure being constructed and arranged to enable lubricant to be delivered to the interior of the at least one of the shafts.

29. The shredder of claim 28, wherein the lubricant receiving structure communicates with a delivery structure configured to enable fluid to flow axially towards the center of the at least one of the shafts at a faster rate than radially towards the openings.

30. The shredder of claim 28, wherein the at least one of the shafts is constructed and arranged such that after the lubricant is delivered to the interior of the at least one of the shafts using the lubricant receiving structure, the lubricant flows radially and axially through the at least one of the shafts to the openings.

* * * * *